US009456662B2

(12) United States Patent
Poulakis

(10) Patent No.: US 9,456,662 B2
(45) Date of Patent: Oct. 4, 2016

(54) METHOD FOR SURFACE FUNCTIONALIZATION OF A SURFACE FASTENER PART AND SURFACE FASTENER PART PRODUCED USING THE METHOD

(75) Inventor: Konstantinos Poulakis, Hildrizhausen (DE)

(73) Assignee: GOTTLIEB BINDER GMBH & CO KG, Holzgerlingen (DE)

( * ) Notice: Subject to any disclaimer, the term of this patent is extended or adjusted under 35 U.S.C. 154(b) by 1116 days.

(21) Appl. No.: 12/737,708

(22) PCT Filed: Jul. 23, 2009

(86) PCT No.: PCT/EP2009/005339

§ 371 (c)(1),
(2), (4) Date: Feb. 9, 2011

(87) PCT Pub. No.: WO2010/031458

PCT Pub. Date: Mar. 25, 2010

(65) Prior Publication Data

US 2011/0146033 A1 Jun. 23, 2011

(30) Foreign Application Priority Data

Sep. 20, 2008 (DE) ..... 10 2008 048 205

(51) Int. Cl.
*A44B 18/00* (2006.01)

(52) U.S. Cl.
CPC ..... *A44B 18/00* (2013.01); *Y10T 24/27* (2015.01)

(58) Field of Classification Search
USPC ..... 427/207.1, 248.1; 24/442, 447, 448
See application file for complete search history.

(56) References Cited

U.S. PATENT DOCUMENTS

| | | | | |
|---|---|---|---|---|
| 6,113,824 | A * | 9/2000 | Yamana et al. | 264/82 |
| 6,733,860 | B1 * | 5/2004 | Poulakis | 428/100 |
| 2003/0126724 | A1 | 7/2003 | Kono et al. | |
| 2004/0134045 | A1 * | 7/2004 | Poulakis et al. | 24/442 |
| 2005/0268439 | A1 * | 12/2005 | Poulakis | 24/445 |

FOREIGN PATENT DOCUMENTS

| | | | |
|---|---|---|---|
| DE | 296 22 981 | U1 | 10/1997 |
| DE | 101 23 205 | A1 | 11/2002 |
| DE | 10 2006 028 581 | A1 | 12/2007 |
| EP | 1 082 032 | B1 | 2/2002 |
| WO | WO 2008/076391 | A2 | 6/2008 |

* cited by examiner

*Primary Examiner* — Elizabeth Burkhart
(74) *Attorney, Agent, or Firm* — Wenderoth, Lind & Ponack, L.L.P.

(57) ABSTRACT

A method surface functionalizes and produces a surface fastener part (12) forming a surface faster (10) that can be opened and closed repeatedly with a mating surface fastener part (14). The surface fastener parts (12, 14) include protruding hook parts (18) disposed at least partially on a carrier part (16), each having a head part (20) on its side facing away from the carrier part (16) and forming a fastening element (22). At least one part of the hook parts (18) of a locking part (12, 14) is provided with a functional medium. The associated head parts (20) are kept largely or completely away from the medium. The fastening forces for engaging the corresponding fastening elements (22) and forming the closed surface fastener (10) are then reduced. The holding forces are then increased up to separating the corresponding fastening elements (22) and forming the opened surface fastener (10).

15 Claims, 2 Drawing Sheets

METHOD FOR SURFACE FUNCTIONALIZATION OF A SURFACE FASTENER PART AND SURFACE FASTENER PART PRODUCED USING THE METHOD

FIELD OF THE INVENTION

The invention relates to a method for surface functionalization of a surface fastener part which forms a surface fastener that can be opened and closed repeatedly with a correspondingly designed surface fastener part. At least one of the surface fastener parts has protruding hook parts disposed at least partially on a carrier part. The hook parts have a head part on their side facing away from the carrier part and form a fastening element with it.

BACKGROUND OF THE INVENTION

DE 10 2006 028 581 A1 discloses a generic method in addition to a device for surface functionalization of surface fastener parts. In the known method, the surface energy of the surface fastener part is modified using high energy by a proton and/or electron exchange medium, especially in the form of donors or collectors. The chemical and physical properties of the material of the surface fastener part can then be adjusted to be free of coatings and resistant to aging by functional groups of the exchange medium being incorporated in the material of the surface fastener part. In particular, by using basic electron donors such as amino, amido, and/or imido groups and compounds, an $NH_3$ group can be incorporated as a functional group on the top of the surface fastener part. It allows a asymmetrical urea bond to build up with other functional groups. This bond exhibits another reactive group onto which the polyurethane of foam materials in the cushion foam can settle. This functionalizing leads to an exceptionally good bonding of the surface fastener part in the molded foam and plays a major part especially in areas of automotive engineering. The entire surface of the respective surface fastener part is accordingly modified with the known method and associated device.

EP 1 082 032 B1 discloses a comparable surface fastener part, especially for enclosing the cushion parts of motor vehicle seats in foam during their production. Fastening elements on one side are connected to the corresponding fastening elements of another surface fastener part with the formation of a surface fastener. A connector in the form of an adhesive medium as a functional medium on the other side of the surface fastener part produces a connection to the respective foam material, wherein the adhesive medium is incorporated into the surface fastener part itself and the adhesive medium is fluorine. In particular, the fluorine is applied in gaseous form in a nitrogen atmosphere to the entire top of the surface fastener part with its components, i.e., the hook, head, and carrier part, after their complete fabrication. Better bonding of the surface fastener part to the corresponding foam material can be achieved than by adhesives which, as a rule, are conventionally used in this field.

EP 1 082 031 B1, conversely, discloses a sol-gel method in order to coat the surface of surface fastener parts in a nano-composite manner. The coating applied in this way acts to repel the foam and effectively opposes the possible penetration of the foam material into the intermediate spaces of the fastening elements when foaming, although the foam can exhibit viscosities which are less than that of water in order to thus maintain the function of the fastener material for later engagement of corresponding fastening elements of another surface fastener part.

Furthermore, WO 2007/036252 discloses a method for producing a fixing device, preferably in the form of a surface fastener part, comprising the formation of a carrier structure as the carrier part which is provided with hook-shaped fixing elements connected to one another at least in pairs via an intermediate element with cramp-shaped, in particular a U-shaped, fixing part. The hook-shaped fixing elements extend through the carrier structure and protrude over it. The intermediate element extends between these fixing elements on the carrier structure. By incorporating the respective fixing element in its entirety into the carrier structure which for this purpose is made cramp-shaped, in particular U-shaped, as a molded part before incorporation, it can be joined to the carrier structure at high speed by using a type of shot mechanism for the fixing parts. Surprisingly good product qualities can be achieved. These pad-shaped surface fastener parts have also become known in the trade under the trademark Duotec®. These types of surface fastener parts can also be woven or knitted. The fixing elements, formed of a plastic which can be easily thermally processed, for example, polypropylene or polyamide which can be also be fixed in a defined manner in metallic carriers, have no surface modification at all.

Within the scope of current practice, it has been shown in these fasteners having a surface fastener part with a correspondingly designed, especially identically made, surface fastener part forms a fastener mechanism that can be opened and closed repeatedly. When the adjacent fastening elements engage one another for purposes of closing of the fastener, very high closing forces arise. Very high mounting forces must be applied by hand. With respect to the holding forces which must be implemented in the opposite direction to prevent the fastening elements inadvertently parting or releasing, the magnitude of the adhesive force values to be achieved leaves much to be desired. In particular, when vibrations and other shaking occur, it is possible, at least for some of the fastener systems available on the market, that the surface fastener parts may inadvertently detach, for example, with the result that heavy wall panels (head liners) can be inadvertently detached from the pertinent vehicle frame parts. This detaching is associated with a certain risk potential.

SUMMARY OF THE INVENTION

An object of the invention is to provide an improved method, in addition to a surface fastener part, which does not have these described disadvantages, and, in particular, enables low closing forces when the surface fastener is closed, yet exhibits high holding forces for the closed surface fastener.

This object is basically achieved by a method in which at least some of the hook parts of a surface fastener part are provided with a functional medium, and the assignable head parts are kept largely or completely away from said medium. The closing forces for intermeshing of the corresponding fastening elements with formation of the closed surface fastener are reduced, and the holding forces are increased until the corresponding fastening elements are moved apart to open the closed surface fastener. The head parts which have not come in contact with the functional medium exhibit favorable sliding behavior such that when intermeshing, they can slide past one another essentially without resistance into the intermediate spaces formed by the hook parts of the other fastener part. The closing forces are reduced accordingly. If the fastener is closed, the edge-side regions of the respective head parts fit between the clearances of adjacent hook parts of the other fastener part. The clearances form the intermediate space. The hook parts come into contact with the functional medium of the respective hook part which is adjacent and which increases friction in order to make it difficult for the corresponding fastening elements to separate. This arrangement leads to an increase of the holding forces within in the desired range until the opening process of the fastener begins. Depending on the suitable functional medium and the plastic material used for the fastening elements, the closing forces can be cut in half, whereas the holding forces can be doubled and more. This fastening ensures that components which interact with the respective surface fastener, such as roof or wall panels, cannot inadvertently detach from the base structure, even if they are exposed to oscillations or strong vibrations. For installation personnel, the closing of the fastener with its two corresponding surface fastener parts is considerably facilitated so that installation parts can be efficiently fixed on the base structures.

It has been shown to be especially preferable to apply halogens as the functional medium in the gaseous phase in the form of a coating to at least some of the hook parts of a surface fastener part. Preferably, however, all hook parts of each surface fastener part which form the surface fastener part in pairs to one another are thus provided with the functional medium. The halogen is preferably fluorine or one of its compounds such as chlorine fluoride (ClF) or chlorine trifluoride ($ClF_3$).

With the method, both cast fasteners and also woven or knitted fasteners can be provided with the functional medium.

In the cast fasteners, first the hook parts are fabricated together with the carrier part, and then the fluorine functional medium in the gaseous phase is applied by way of a suitable device. Then the heated hook ends are formed into head shapes so that the tops of the fastener heads are definitely free of the functional medium, whereas the hook parts have the functional medium on the outer peripheral side. If the thermoplastic material is polypropylene, the sliding properties are especially favorable for the untreated top of the fastener head.

If a weaving or knitting method is used to obtain a surface fastener part from monofilaments and/or multifilaments, at least the protruding loops which have been woven or knitted in can be fluorinated for this purpose. After cutting open the respective loop, the free loop ends which form the ends of the hook parts, by being flame-scarfed on or provided with some other heat input, can form the head part. The thermoplastic material is transformed as a result of its surface tension into a type of dome-shaped or hemispherical head part. This forming can also be supported by an additional head forming means. If not all loops are modified in this way, surface fastener parts can be formed which, in addition to interlocking loops on one top of the carrier part, also have the fastener heads in addition to the pertinent hook parts as fastening elements. The cut loops can also be partially reconfigured into hook-shaped fastening elements so that, in addition to mushroom-shaped fastening elements, hook-shaped fastener parts can also protrude on the top of a surface fastener part.

If the carrier part of the respective surface fastener part is also surface-functionalized as outlined, then, as a result of the reactive functional groups of the fluorine medium, this functionalizing allows improved adhesion of a finish. Depending on the finish chosen, the fastener can be made flame-resistant and heat-resistant. At the same time, the adhesion of the woven-in fastening elements of woven fasteners is improved relative to the carrier part by the finish, so that the fastening element accordingly is reliably prevented from being pulled out in operation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
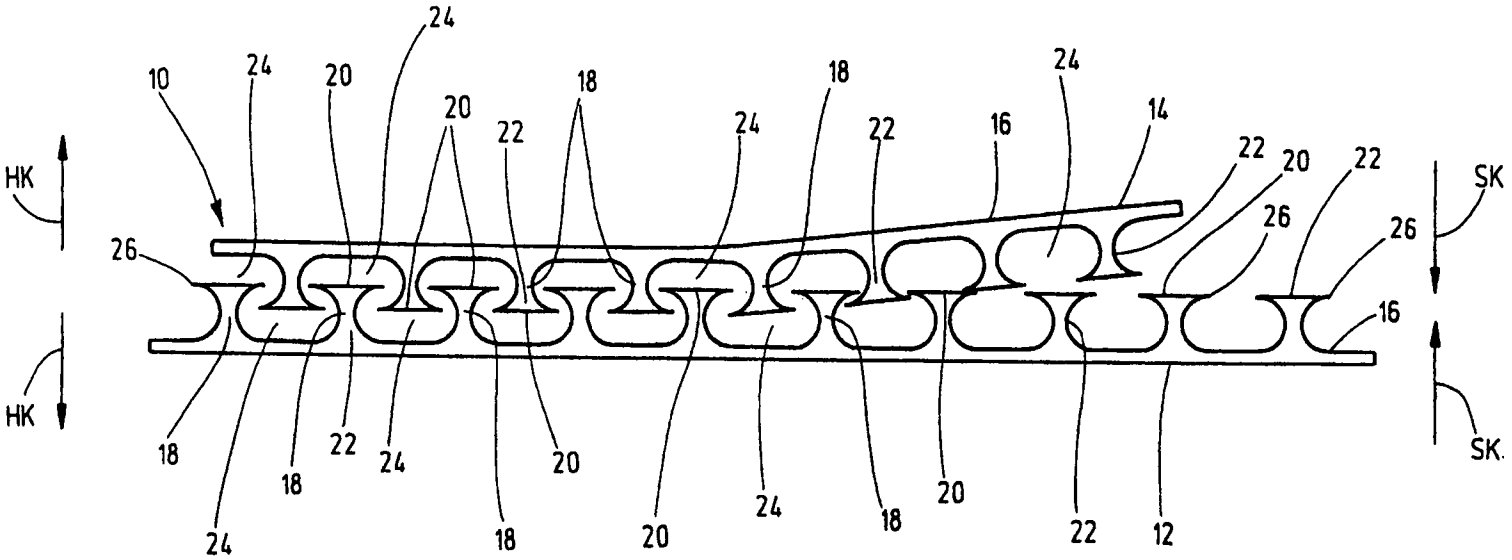
FIG. 1 is a partial side elevational view of a surface fastener made by a method according to an exemplary embodiment of the invention.

The surface fastener 10 shown partially in FIG. 1 has a surface fastener part 12 which, with a correspondingly formed surface fastener part 14, forms the surface fastener 10 which can be opened and closed repeatedly. Surface fasteners made in this way in terms of their function are also well known under the trademark Kletten® surface fastener among experts in the technical field and end user circles. The fastener solution shown in FIG. 1 is moreover commercially available under the trademark Microduotec®. As FIG. 1 furthermore shows, each surface fastener part 12, 14 has a carrier part 16 which extends band-shaped or as a surface and as a three-dimensional article into and out of the plane of the drawing. At least on one side of the respective carrier part 16, there are hook parts 18 which on their free face ends and therefore facing away from the respective carrier part 16 are provided with head parts 20 in one piece. Each hook part 18 with its head part 20 forms a cast fastening element 22, which in this case protrudes on the top of the carrier part 16 in rows in the transverse and longitudinal directions.

As FIG. 1 further shows, the head parts 20 with their assignable hook part 18 of one surface fastener part 12 fit into intermediate spaces 24 of the other surface fastener part 14. These intermediate spaces 24 are formed essentially by the clearances of the adjacent hook parts of a surface fastener part 12, 14, corresponding intermediate spaces 24 being in the other surface fastener part 12. For reliable intermeshing of the surface fastener parts 12, 14 and to obtain high holding forces with the surface fastener closed, as is shown in the direction of the left half of FIG. 1, it is advantageous if the head parts 20 on the outer peripheral side have an enclosing edge 26 which is correspondingly sharp-edged and which, however, to a certain extent can constitute a barrier. Viewed in the direction of FIG. 1 on the right half of the figure, the surface fasteners are to be intermeshed with one another to close the fasteners. This intermeshing is inhibited by the head parts extending along the sharp edge. The closing and holding forces oriented in opposite directions are designated as SK and HK in FIG. 1 as force arrows. For the sake of better understanding, it should be clarified that the fastening elements 22 are generally formed from a thermoplastic. In an elastically resilient manner, these fastening elements enable intermeshing of the head parts 20 of adjacent surface fastener parts and support the detachment process in order to open the fastener.

Because, at least for the purposes of the method according to the invention, the hook parts 18 of a surface fastener part 12 or 14 are provided with a functional medium and the respective head parts 20 are kept largely or entirely away from that medium, the closing forces SK for intermeshing of the corresponding fastening elements 22 can be reduced with the formation of the closed surface fastener 10, and the holding forces HK can be considerably increased until the corresponding fastening elements 22 are moved apart with the formation of the opened fastening part 10. The head parts 20 have not come into contact with the functional medium on their top and have a favorable sliding behavior to the extent that when meshing, they can slide past one another essentially without resistance into the intermediate spaces 24 formed by the hook parts 18 of the other fastening part 12 or 14. In this way the closing forces SK are reduced. The head parts 20 without the functional media have favorable sliding properties in terms of plastic behavior. The hook parts, on which the functional medium remains, effect an increase of friction and therefore improved residual adherence to one another before a boundary value of the holding forces HK is exceeded. This arrangement necessarily leads to the release of the closed surface fastener 10 and is also desirable for implementing a Kletten® surface fastener that can be opened and closed repeatedly.

Controlled use of the functional medium makes it possible to significantly reduce the closing forces. This control makes installation efforts easier for the installer. Conversely, the holding forces HK are markedly increased in pulling oppositely. The surface fastener 10, once closed, bears high loads and weights. This ability is important, for example, in motor vehicle construction when the head liner is fixed on the base structure of the vehicle body in the interior of the vehicle against the force of gravity. It has been shown that under ambient conditions with high temperatures and with the vibrations and oscillations which occur when driving, the head liner fixed by the appropriately modified surface fasteners 10 remains in its installed position.

The fastener 10 shown in FIG. 1 can be obtained as continuous strip goods or sheet goods by a cast-forming method which is also referred to as a chill-roll method. This forming method is described, for example, in DE 10 2006 028 581 A1. The single figure of this application shows parts of a production device with an extruder head as the feeder for plastic material in the plastic or liquid state, especially thermoplastic, such as polypropylene (PP). The plastic material is formed as a band whose width corresponds to that of the surface fastener part 12 or 14 to be produced, and is supplied to a gap between a pressure tool and a forming tool designed as rollers and interacting with one another in the manner of roller framing. For actual forming, the forming roller on its periphery has a forming screen with individual mold cavities which generate the individual fastening elements 22, that is, respective hook part 18 with head part 20, on a carrier part 16.

In contrast to this known solution, within the scope of the present method according to the invention, only the carrier part 16 with the hook parts 18 cast in one piece is obtained as a preliminary product, without molding-on of the respective head part 20. Regardless of the geometry of the hook parts as a hook part cylinder or as a hook part hyperboloid, they then together with the carrier part 16 are placed into a conventional fluorination device as is shown, for example, in the single figure of EP 1 082 032 B1. Preferably, the functional medium is in the form of fluorine gas at 3 to 10% being incorporated at room temperature and a negative pressure of about 650 millibars in a closed application chamber. Fluorination can be carried out continuously, preferably in a selected temperature range from 40° C. to 50° C. in a nitrogen atmosphere and the corresponding prevailing negative pressure in the indicated treatment chamber.

If the top of the respective carrier part and the hook parts 18 are coated on the outer peripheral side with the functional medium, preferably in the form of fluorine which has been applied in gaseous form, in a subsequent known calender rolling method, the hook end is worked into the head part 20. This working yields head geometries as shown in FIG. 1 with a face surface made corresponding flat. They can be reshaped by a separate head forming tool, for example, into the head shapes which are polygonal when viewed in cross section.

Another possibility for producing these surface fasteners 10 is disclosed, for example, by EP 1 534 096 B1 which relates to a flat surface fastener part 12 for a surface fastener 10 in which fastening elements 22 which detachably correspond to one another can be caused to engage one another. This solution includes a base fabric as the carrier part 16 of warp threads and woof threads and has at least one function thread 28 (compare FIG. 2) made preferably as a monofilament thread, extending partially through the base fabric and forming the fastening elements 22. A fastener woven in this way is also readily available under the trademark Duotec®.

Figure 2:
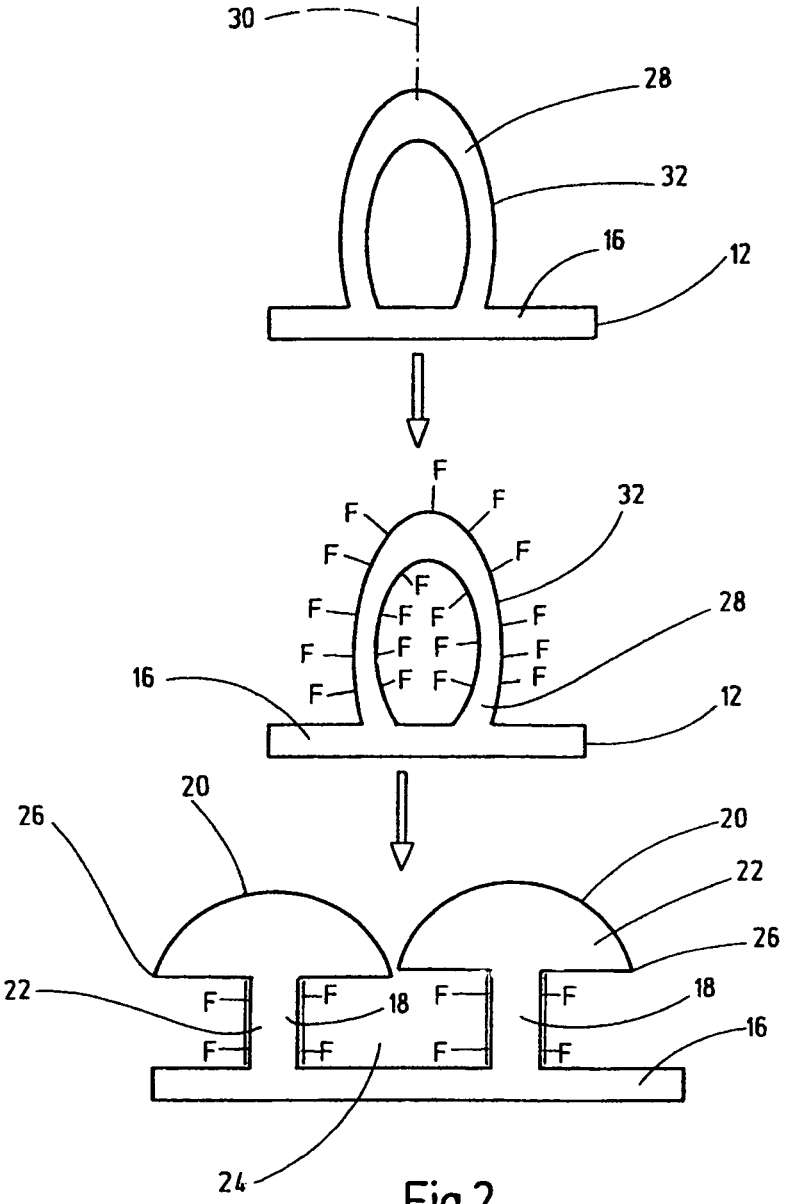
FIG. 2 are side elevational views in the form of a chronological flow chart of the production of a surface-functionalized surface fastener part from a preliminary stage to an end stage according to an exemplary embodiment of the invention.

Viewed in the direction of FIG. 2, the above-described starting product is shown at the top. If a fastening part with loops is not needed, but one with a mushroom-shaped or hook-shaped character, the fastening loop is cut by way of a suitable cutting device (not shown) along the cutting line 30. This operation is conventional in the prior art.

In contrast to this known solution, in the method according to the invention, the fastening loop 32, formed from the function thread 28, is, however, first retained. The modified surface fastener part 12 is initially conveyed to a fluorination process, as described above. The fluorine functional groups designated as F generally surround the entire outer surface of the fastening loop 32. In general, the carrier part 16 of warp and woof threads is also fluorinated. In the following further step, the fastening loop 32, as already shown, is cut along the cutting line 30. The free loop ends which, for example, spring away from one another as a result of the inherent elasticity of the woven material are flame-scarfed on the end side. As a result of the surface tension of the plastic material used, head parts 20 are then formed which are made hemispherical or dome-like according to the lowermost representation viewed in FIG. 2.

Since for shaping the hook parts 18 into the respective head part 20 more or less half of the fastening loop 32 is used. In the formation of the head part at the same time fluorine is also melted on as the functional medium. In the region of the head part 20, this melting leads to the fluorine being statistically distributed either by being volatilized or finely dispersed within the head part 20 under the influence of heat. Ultimately, however, this heating ensures that hardly any of the functional medium in the form of fluorine, or in a very low concentration only, is present on the top of the respective head part in terms of the statistical fluorine distribution pattern. The outer periphery of the hook parts 18 continues to exhibit large numbers of fluorine functional groups. Considered as a whole, the outer peripheral side of the respective head part 20 is therefore formed from the slippery plastic material, preferably in the form of polypropylene. The outer periphery of the hook parts 18 exhibits the fluorine functional medium which increases the friction on the hook parts 18 in order to effect the disengagement of the corresponding surface fastener parts 12, 14 in terms of increasing the holding force HK. Likewise, the sliding plastic surface for the head parts allows a reduction of the closing forces SK, as described. This produced fastener part is especially favorable for installation.

Since in this exemplary embodiment, as shown in FIG. 2, the carrier part 16 is designed to be of a base fabric of warp and woof threads, cutting the loop material as a rule also makes it possible for the loop material which has been woven into the carrier part 16 to be pulled out under the action of a force on the head parts 20. By applying the fluorine function material to the base fabric of the carrier part 16, reactive fluorine groups are available in the carrier part 16 which particularly facilitate adhesion of a finish, and which generally make it much more difficult for the fastening elements 22 to be pulled out. Moreover, the finish (not shown) can also be modified in terms of its properties, for example, can be made flame-retardant, such that the surface fastener part produced in this way is especially heat-resistant.

Instead of fluorine, other functional media which have proven suitable and which can preferably be applied in gaseous form can also be used. As a rule, halogens have been found to be especially suited. Particularly good values can be achieved when using chlorine fluoride or chlorine trifluoride as the functional medium, but they can be slightly more expensive than the gaseous fluorine material used here.

Another option for manufacture of fasteners is disclosed in WO 2007/036252 in which as the carrier part 16 U-shaped fastening elements in the form of cramps can be shot into a metal base body. The fixing parts modified for the shot process can be provided first with the functional medium, and then in turn the head part is formed via a thermal forming method, such as flame-scarfing or by a roller calendering method known in the prior art.

It is surprising to one with average skill in the art in the field of surface fastener technology that by controlled attachment of functional groups such as fluorine components to sites distributed geometrically or three-dimensionally on a surface fastener part, the proper functioning can be adjusted and optimized within such a broad framework.

While one embodiment has been chosen to illustrate the invention, it will be understood by those skilled in the art that various changes and modifications can be made therein without departing from the scope of the invention as defined in the appended claims.

What is claimed is:

1. A method for functionalization of a surface fastener part that can be opened and closed repeatedly with a mating surface fastener part, comprising the steps of:

providing a surface fastener part with protruding hook parts disposed at least partially on a carrier part, the hook parts having unitary one piece head parts on ends of the hook parts remote from the carrier part to form a fastening element;

providing a functional medium on at least some of the hook parts; and forming the head parts to be substantially free of the functional medium;

whereby, closing forces to intermesh the surface fastener part with a mating surface fastener part forming a closed surface fastener are reduced, and holding forces resisting disengagement of elements of the surface fastener parts are increased.

2. A method according to claim 1 wherein the functional medium is a halogen in a gaseous phase applied as a coating at least to parts of the hook parts.

3. A method according to claim 2 wherein the halogen is selected from the group of chlorine fluoride and chlorine trifluoride.

4. A method according to claim 1 wherein the surface fastener part is made from at least one of monofilaments and multifilaments by one of a forming method, a weaving method and a knitting method.

5. A method according to claim 4 wherein said surface fastener part is formed of a thermoplastic material.

6. A method according to claim 5 wherein said thermoplastic material is polypropylene.

7. A method according to claim 4 wherein the hook parts are cast with the carrier part without the head parts into a hook parts-carrier part combination;

the hook-parts-carrier part combination is then surface-functionalized; and in a subsequent method step, ends of the hook parts are heated to form the head parts thereon substantially free of the functional medium.

8. A method according to claim 4 wherein in one of the weaving method and the knitting method, loops initially woven or knitted into the carrier part are cut after performing surface functionalization; and cut ends of the loops are formed into the head parts at least in part by heating with other loop components protruding from the carrier part forming hook parts.

9. A method according to claim 4 wherein the carrier part is subjected to surface functionalization by application of the functional medium.

10. A method according to claim 9 wherein the surface functionalization of the carrier part enables better adhesion of a finish thereof.

11. A surface fastener part, comprising:

a carrier part;

hook parts protruding from said carrier part;

head parts being formed integrally on said hook parts and being entirely one-piece structures with said hook parts, said head parts having free end surfaces on ends thereof remote from said hook parts; and a functional medium coating said carrier part and said hook parts, without any substantial functional medium coating on said free end surfaces.

12. A method of making a touch-and-close fastener part comprising the steps of:

making a carrier part having protruding hook parts without head parts;

applying a functional medium coating to the hook parts and the carrier part; and forming head parts on free ends of the hook parts remote from the carrier part by heating after applying the functional medium such that the head parts have free surfaces remote from the hook parts substantially free of the functional medium coating and such that all of each the head parts is a unitary, one-piece structure with the respective hook part.

13. A method according to claim 12 wherein the functional medium is fluorine gas.

14. A method according to claim 12 wherein the head parts are formed with a calendar roll.

15. A method according to claim 12 wherein the heating statistically distributes the functional medium coating on portions of the hook parts forming the head parts by being one of volatilized or finely dispersed within the head parts.

* * * * *